US005734303A

United States Patent [19]

Baca

[11] Patent Number: 5,734,303

[45] Date of Patent: Mar. 31, 1998

[54] MICROWAVE WAVEGUIDE MODE CONVERTER HAVING A BEVEL OUTPUT END

[75] Inventor: Ernest A. Baca, Alb., N. Mex.

[73] Assignee: The United States of America as represented by the Secretary of the Air Force, Washington, D.C.

[21] Appl. No.: 412,259

[22] Filed: Mar. 28, 1995

Related U.S. Application Data

[63] Continuation-in-part of Ser. No. 215,791, Mar. 11, 1994, abandoned.

[51] Int. Cl.[6] ..... H01P 1/16

[52] U.S. Cl. ..... 333/21 R; 315/5

[58] Field of Search ..... 333/21 R; 315/4, 315/5; 331/79

[56] References Cited

U.S. PATENT DOCUMENTS

| | | | |
|---|---|---|---|
| 3,818,383 | 6/1974 | Willis | 333/21 R |
| 4,636,689 | 1/1987 | Mourier | 315/5 X |
| 4,973,924 | 11/1990 | Bergero et al. | 333/21 R |
| 5,030,929 | 7/1991 | Moeller | 333/21 R |
| 5,266,962 | 11/1993 | Mobius et al. | 333/21 R |
| 5,302,962 | 4/1994 | Rebuffi et al. | 333/21 R |

FOREIGN PATENT DOCUMENTS

| | | | |
|---|---|---|---|
| 814204 | 11/1987 | U.S.S.R. | 333/21 R |

*Primary Examiner*—Benny T. Lee
*Attorney, Agent, or Firm*—Stanton E. Collier

[57] ABSTRACT

The present invention comprises a microwave mode convert having a cylindrical waveguide input. Attached to the waveguide input is a transition section which gradually changes from the elliptical or cylindrical waveguide input. The output section is also an elliptical waveguide. The output section may also have an elliptical or cylindrical waveguide attached to it. The mode converter of the present invention has input a $TM_{01}$ mode microwave energy from a cylindrical waveguide and outputs $TE_{11}$ or TEM mode microwave energy which is an elliptical or circular pencil beam of radiation with high directivity.

7 Claims, 14 Drawing Sheets

FIG. 2(a)
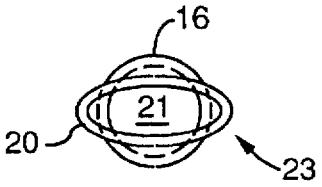
FIG. 2(b)
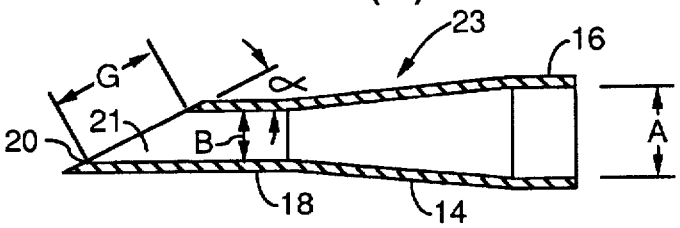
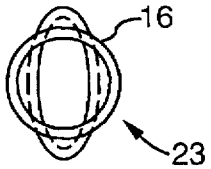
FIG. 2(c)
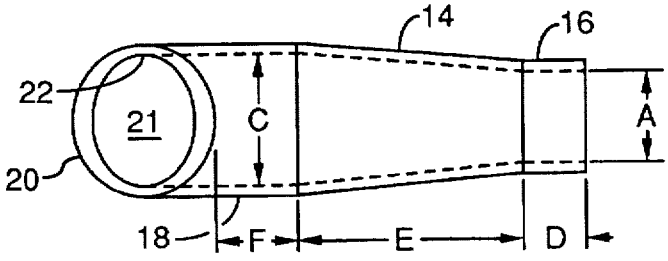
FIG. 2(d)
23
FIG. 3(a)
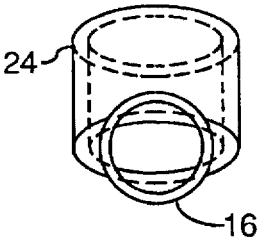
FIG. 3(b)
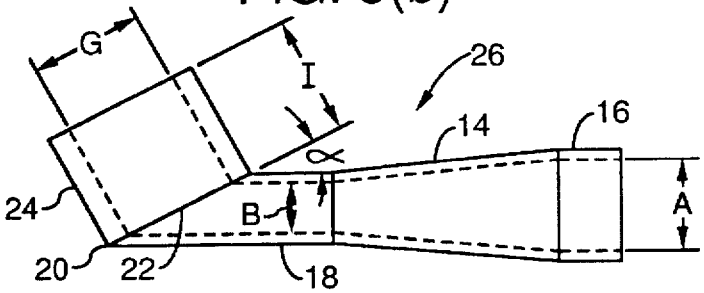
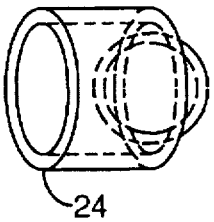
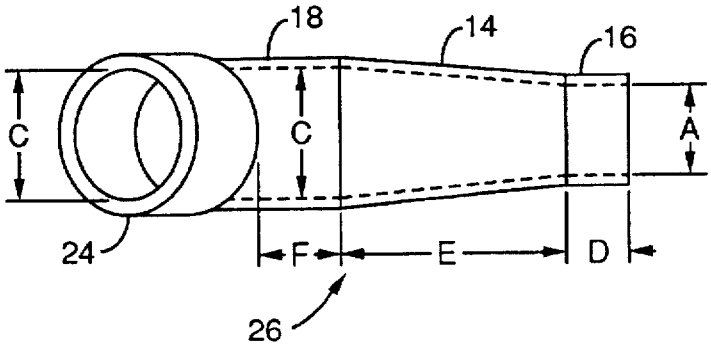
FIG. 3(c)
FIG. 3(d)

| WAVE TYPE | $TM_{01}$ |
| --- | --- |
| FIELD DISTRIBUTION IN CROSS-SECTIONAL PLANE, AT PLANE OF MAXIMUM TRANSVERSE FIELDS |  |
| FIELD DISTRIBUTION ALONG GUIDE |  |

ELLIPTICAL WAVEGUIDE
CONSTANT Z TRANSITION

| | | |
|---|---|---|
| ECCENTRICITY | = | .900 |
| FREQUENCY | = | 18.00 GHz |
| DIAMETER / LAMBDA | = | 1.24 |
| DIRECTIVITY | = | 16.30 dB |
| POLAR HPBW | = | 27.90 DEG |
| AZIMUTHAL HPBW | = | 33.97 DEG |
| APERTURE AREA | = | L^2 |

CONSTANT IMPEDANCE TRANSITION
FROM
CYLINDRICAL TO ELLIPTICAL WAVEGUIDE
WITH
CIRCULAR APERTURE

| | | |
|---|---|---|
| ECCENTRICITY | = | .90 |
| FREQUENCY | = | 18.00 GHz |
| DIAMETER / LAMBDA | = | 1.24 |
| DIRECTIVITY | = | 18.96 dB |
| POLAR HPBW | = | 18.20 DEG |
| AZIMUTHAL HPBW | = | 22.06 DEG |
| BEAMWIDTH RATIO | = | 1.21 |
| APERTURE WIDTH | = | 3.95 L |
| APERTURE LENGTH | = | 5.63 L |

MICROWAVE WAVEGUIDE MODE CONVERTER HAVING A BEVEL OUTPUT END

BACKGROUND OF THE INVENTION

The present application is a continuation-in-part of patent application Ser. No. 08/215,791, filed 11 Mar., 1994, abandoned, entitled Microwave Waveguide Mode Converter.

STATEMENT OF GOVERNMENT INTEREST

The invention described herein may be manufactured and used by or for the Government for governmental purposes without the payment of any royalty thereon.

The present invention relates to microwave devices, and, in particular, relates to microwave waveguides, and, further, relates to means for converting modes and transmitting a narrow beam of radiation from a desired output mode.

Efficient transmission of radiated microwave energy to a target by tactical high power microwave weapons over large distances requires a single narrow beam of energy. For such weapons, maximum energy density on target is one of the primary goals. This requirement in the absence of others dictates that maximum gain antennas be used. A non-uniformly polarized beam may be useful to allow penetration of electromagnetic energy into the target. Since tactical weapons also need to be compact, a large aperture efficiency may also be needed to fulfill mission requirements. Electromagnetic breakdown issues associated with the gigawatt power levels produced in high power sources currently make aperture antennas such as conical horns for cylindrical waveguides or pyramidal horns for rectangular waveguides a logical choice. These antennas usually function by radiating the fundamental TE mode for the respective waveguide and offer the maximum single mode gain (and aperture efficiency) obtainable. However radiation of up to five (5) modes has been employed as early as 1963 for beam shaping purposes as demonstrated by P. D. Potter and A. C. Ludwick. Many candidate high power microwave sources, such as the gyrotron, the backward wave oscillator, and the virtual cathode oscillator, generate power in the $TM_{01}$ or $TE_{01}$ modes which do not produce a suitable farfield radiated beam when driving conventional conical or pyramidal horns.

In the past, the following devices were used to transport $TM_{01}$ mode energy into a single beam from aperture antennas: The $TM_{01}$ mode is converted to a $TE_{11}$ mode (cylindrical waveguide) or to a $TE_{10}$ mode (rectangular guide) and radiated from conventional optimum gain conical horn or rectangular horn which provides aperture efficiencies of 50% and 51% respectively. Some of the devices used to convert $TM_{01}$ mode to a $TE_{11}$ or $TE_{10}$ mode include: serpentine waveguide bends: M. J. Burkley, G. H. Luo and R. J. Vernon, "New Compact High-efficiency Mode Converters for High Power Microwave Tubes with $TE_{0n}$ or $TM_{0n}$ Mode Outputs," 1988 IEEE MTT-S Digest, pages 797–800. This converter has a 98% mode conversion efficiency. Mode converters such as this are capable of very high power operation but are bulky (generally longer than 6 operating frequency wavelengths in total length), very expensive to manufacture and operate efficiently only over a very narrow band (5% bandwidth for >90% conversion); cylindrical-to-rectangular waveguide converter: G. L. Ragan, "Microwave Transmission Circuits," New York c 1948. This device was used to convert a $TE_{10}$ mode (rectangular waveguide) to $TM_{01}$ mode (cylindrical waveguide) for use in a rotary joint. Reverse operation of the device would allow a $TM_{01}$ mode to be converted to a $TE_{10}$ mode which can be radiated from a pyramidal horn. Data presented by Ragan indicated narrow band operation with respect to mode conversion and power transmission efficiency. The electroforming process that was used to fabricate the converter is expensive; simple waveguide bends: Moffa P., M. Makowski, S. Ross, and B. Katta, "Manufacture and test of a 1.3 GHz Mode converter/Filter", TRW Report BPPR-87-3 July 1987. This mode converter is capable of high power broadband operation, but is very bulky, difficult to machine and has only a 62.5% theoretical maximum conversion efficiency; and a linear tapered finned circular waveguide: "High-Power Microwave Mode Converter and Antenna Development," Air Force Weapons Laboratory Technical Report AFWL-TR-88-119, March 1989. This converter is compact (approximately 3.65 operating frequency wavelengths in length) and has a 70% conversion efficiency over a 25% bandwidth. However this device could suffer from breakdown at high powers due to very high field stress induced by its asymmetric fin construction. The estimated $80,000 fabrication cost makes this a very expensive converter.

One prior device used for converting the $TM_{01}$ mode and radiating from a non conventional antenna is the "Vlasov-Type" converter. Vlasov, S. N. et al, "Quasioptical Transformer which Transforms the Waves in a Waveguide Having a circular Cross Section Into a Highly Directional Wave Beam," *Radiofizika*, USSR, Vol. 17, No. 1, 148–154 (1974). As shown in FIG. 1(*a*), this device 10 has a step-cut aperture from which the final radiation emits. Another prior mode converter is the "Nakajima-type" shown in FIG. 1(*b*). Wada, O., Nakajima, M., "Quasi Optical Reflector Antennas for High Power Millimeter Waves," Proceedings of the EC6-Joint Workshop on ECE and ECRH, Oxford, 369–376 (1987). FIG. 1(*b*) shows the bevel cut cylindrical waveguide 12 having an elliptical aperture from which the final radiation is emitted. B. G. Ruth, R. K. Dahlstrom, C. D. Schlesiger and L. F. Libelo, "Design and Low-Power Testing of a Microwave Vlasov Mode Converter," 1989 IEEE MITT-S Digest, pages 1277–1280. Measurements performed here at the Phillips Laboratory indicate that multiple modes exist within the waveguide leading up to the bevel cut aperture in this radiator. The $TM_{11}$ and $TM_{01}$ mode and small amounts of other higher order modes combine to produce a fan shaped beam with moderate directivity. These same measurements also indicate a Standing Wave Ratio of 1.25, implying a power reflection coefficient of 0.0123. Aperture reflection measurements indicate a high radiation efficiency in the bevel cut converter. The radiators low reflected power is likely due to its adiabatic transition from cylindrical waveguide to free space. A single narrow beam of radiation is produced by conversion of the $TM_{01}$ and $TM_{11}$ mode in a cylindrical waveguide into a TE mode at a bevel cut aperture. These converter/antennas are very inexpensive to manufacture. The directivity can be improved substantially by using a parabolic or elliptic cylinder reflector. However, the reflector size needed makes the antenna bulky and much more expensive to manufacture.

Radiation of the $TM_{01}$ mode from conventional aperture devices produces a low directivity annular beam with a null on axis which is not practical for energy transmission over large distances.

SUMMARY OF THE INVENTION

The present invention is a low-cost mode converter which provides the capability to radiate a highly directive pencil beam of microwave energy from devices that produce such microwaves in a $TM_{01}$ mode. The invention functions by maintaining the $TM_{01}$ mode from the input section throughout the transition section. At the output, the invention then converts to TE modes that are appropriate for producing a pencil beam of radiation.

The present invention comprises a mode converter having a cylindrical waveguide input. Attached to the cylindrical waveguide input is a transition section which gradually changes from a circular cross-section at the input end to an elliptical cross-section near the output end. The converter output is an elliptical aperture cut into an output section connected to said transition section. The output section is also an elliptical waveguide. The output aperture area is shaped in such a manner as to provide an improved impedance match and to minimize spurious mode generation. If the application dictates that radiation be from a cylindrical or elliptical aperture or a horn antenna, the aperture area can be formed to attach to a cylindrical or elliptical waveguide. If the application required a low profile aerodynamically smooth structure such as would be used externally on an aircraft, then the aperture area can be further shaped to radiate directly into space.

The mode converter changes the input $TM_{01}$ mode energy to a set of modes primarily composed of fundamental TE mode microwave energy at the output aperture which results in a highly directive beam of energy. By shaping the aperture appropriately, the resultant farfield radiated beam can be made elliptical or circular. Furthermore, the elliptical orientation of the output beam can be varied to suit the requirement by asymmetric shaping of the aperture area.

One object of the present invention is to provide a mode converter having input a $TM_{01}$ mode which outputs a pencil beam of radiation in a different set of TE modes.

Another object of the present invention is to provide a mode converter that uses a cylindrical to elliptical transition that either connects two cylindrical or elliptical waveguides, connects a cylindrical to an elliptical waveguide, or connects a cylindrical or elliptical waveguide to a shaped radiating aperture.

Another object of the present invention is to provide a mode converter that is of compact design.

Another object of the present invention is to provide a mode converter of low cost as compared to conventional mode converters.

These and many other objects and advantages of the present invention will be readily apparent to one skilled in the pertinent art from the following detailed description of a preferred embodiment of the invention and the related drawings wherein like elements are given like reference numerals throughout.

BRIEF DESCRIPTION OF THE DRAWINGS.

FIGS. 2(*a*)–2(*d*) are different views of the mode converter cylindrical waveguide input, cylindrical to elliptical waveguide transition, elliptical waveguide and a bevel cut output.

FIG. 2(*a*) is a front view of the mode converter of FIG. 2(*b*). FIG. 2(*b*) is a side cross-sectional view of the mode converter. FIG. 2(*c*) is an end view of the mode converter of FIG. 2(*d*). FIG. 2(*d*) is a top view of the mode converter of FIG. 2(*b*).

FIGS. 3(*a*) to 3(*d*) show the same structure of FIGS. 2(*a*) to 2(*d*) with an output cylindrical waveguide attached to the bevel cut output.

FIG. 3(*a*) shows an end view of a waveguide output section as seen in FIG. 3(*b*). FIG. 3(*b*) shows a side view of the waveguide output section of FIG. 3(*a*) attached to the bevel cut output of FIG. 2(*b*). FIG. 3(*c*) shows a top view of the output section of FIG. 3(*d*). FIG. 3(*d*) shows a top view of the waveguide output section and the transition section of FIG. 3(*b*).

FIG. 6(*b*) is a front cross-section of an elliptical waveguide of FIG. 6(*a*).

FIG. 7(*b*) illustrates a $TM_{01}$ mode (Goldberg, Lasleth, and Rimmer, page 1607) distribution in an elliptical waveguide with the same field convention as in FIG. 7(*a*) as noted in reference 3 (Ramo, Whinnery, and Van Duzer, as above). FIG. 7(*c*) (Lan Jen Chu, page 587) illustrates the elliptical waveguide $TE^c_{11}$ (even $TE_{11}$ mode) and 7(*d*) (Lan Jen Chu, same as above) illustrates the elliptical waveguide $TE^s_{11}$ (odd $TE_{11}$ mode).

FIGS. 8(*a*)–8(*c*) is data taken at a frequency of 12.6 GHz and FIG. 8(*d*)–8(*f*) is data taken at 13.1 GHz. FIG. 8(*a*) illustrates an elliptically shaped radiated total power pattern while FIG. 8(*d*) illustrates a more circular shaped total radiated beam. FIG. 8(*b*) and 8(*c*) show the polar (phi angle) and azimuthal (theta angle) components respectively of the total power pattern of FIG. 8(*a*). FIG. 8(*e*) and 8(*f*) show the polar and azimuthal components of the total power pattern of FIG. 8(*d*).

FIGS. 9(*a*)and 9(*c*) are reflection measurements of the prior art of FIG. 1(*b*) taken at 12.1 GHz and 13.1 GHz respectively. FIG. 9(*b*) and 9(*d*) are reflection measurements of the invention embodiment of FIG. 12 taken at 12.1 GHz and 13.1 GHz. These measurements show a reduction in the reflected power over the prior art.

FIG. 13(*a*) illustrates a mode converter of the present invention including the cylindrical waveguide, transition section, elliptical waveguide and aperture area of FIG. 2(*a*) –2(*d*) with a small empirically shaped aperture area. FIG. 13(*b*) illustrates a mode converter of the present invention including the cylindrical waveguide, transition section, elliptical waveguide and aperture area of FIG. 2(*a*)–2(*d*) with a large empirically shaped aperture area.

DESCRIPTION OF THE PREFERRED EMBODIMENT

Figure 1A:
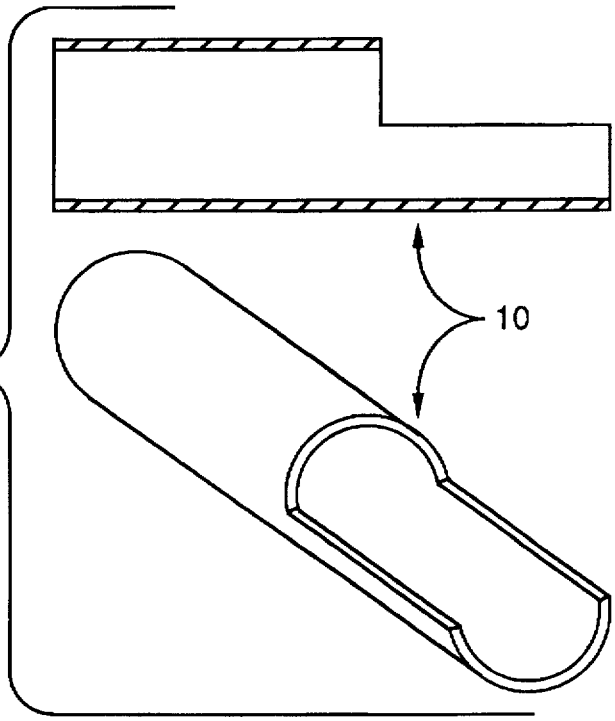
FIG. 1(a) PRIOR ART
FIG. 1(*a*) is a prior art Vlasov type radiator and FIG. 1(*b*) is a prior art Nakajima type radiator.
Figure 1B:
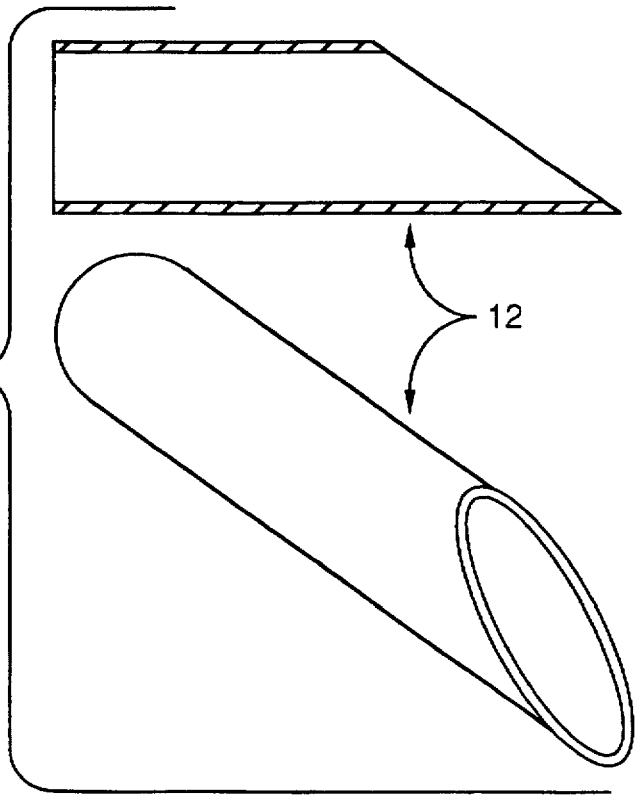
FIG. 1(b) PRIOR ART

FIGS. 1(*a*)–1(*b*) illustrate the conventional Vlasov radiator 10 and Nakajima radiator 12 respectively used to radiate the $TM_{01}$ mode. As seen therein, the waveguides are cylindrical and operate as discussed above. FIGS. 2(*a*) and 2(*c*) show a front view, FIG. 2(*b*) shows a side view and FIG. 2(*d*) shows a top view of a cylindrical waveguide 16 that connects a transition section 14, FIG. 2(*d*), that transitions to an elliptical waveguide 18 with changing eccentricity over a predetermined length as indicated by dimension E. Also shown is a bevel cut output 20 in the elliptical waveguide 18 at an angle α, chosen to create an elliptical aperture 22. If necessary, α may be calculated such that a perfectly circular aperture 22 is created. A perfectly circular aperture is an elliptical aperture of zero eccentricity. With reference to FIG. 2(*b*) and 2(*d*), the eccentricity (*e*) is defined by $\acute{a}=\sqrt{(C^2-B^2)}/C$ where dimension C is the major axis and B is the minor axis of the elliptical waveguide 18. If the specific requirement dictates, surface shaping may be done in and around the output 20, aperture 22 and aperture area 21. FIGS. 2(*c*) and 2(*d*) show a 90 degree rotation about the waveguide longitudinal axis. Dimension F in FIG. 2(*d*) is a predetermined waveguide length of constant eccentricity while dimension D is a section of the cylindrical waveguide 16 with diameter A. If the specific requirement dictates, dimension D and/or F can be of zero length, and dimensions B and C may be such as to provide an eccentricity greater than 0 (cylindrical waveguide) to any value less than 1 (elliptical waveguide). The typical eccentricity is greater than 0.50 and less than 0.95.

FIGS. 3(*a*) to 3(*d*) show the same structure of FIGS. 2(*a*) to 2(*d*), back, FIG. 3(*a*) side, front and top views, with an angled cylindrical waveguide 24 attached to the beveled output 20 in all views of FIGS. 3(*a*) to 3(*d*) where the cylindrical waveguide 24 has an inside diameter equal to the aperture 22 inside dimension G. If the requirement dictates that an angled elliptic waveguide 24 of length I may be attached to the beveled output, then the inside perimeter of the waveguide 24 is equal to the inside perimeter of the elliptical aperture at the output 20. This apparatus is a mode converter 23, FIGS. 2(*a*) to 2(*d*) and 26, FIGS. 3(*a*) to 3(*d*), that is further explained hereinafter All figure item labels (i.e., A, B, 20, etc.) in FIGS. 2(*a*) to 2(*d*) and 3(*a*) to 3(*d*) are described at least once and refer to the same item in all figures even if not referred to specifically herein.

Figure 4A:
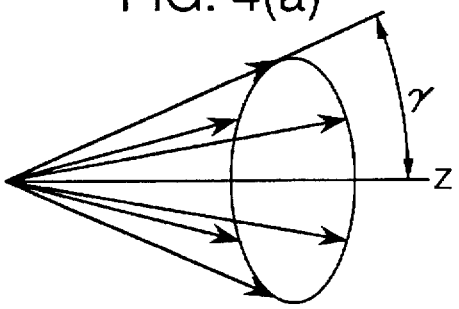
FIGS. 4(*a*)–4(*b*) illustrate ray propagation of $TM_{01}$ mode energy in a cylindrical waveguide.
Figure 4B:
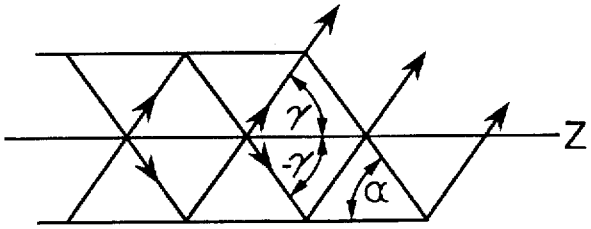
Figure 5:
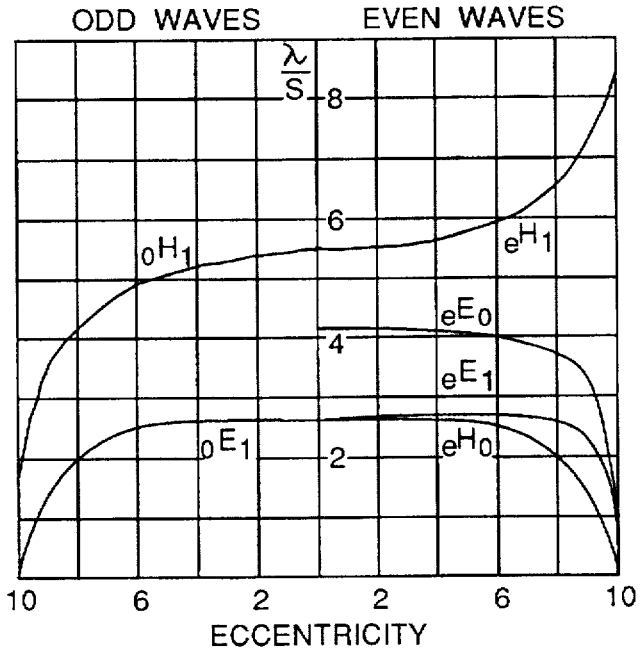
FIG. 5 is a graph of cutoff wavelengths for modes in elliptical and cylindrical waveguides. The cutoff wavelengths for a cylindrical waveguide mode is found at an eccentricity of zero. On this graph, the $TM_{01}$ mode is designated by ${}_eE_0$ as noted (Lan Jen Chu, p. 586).

The operating center frequency and input waveguide eccentricity and diameter determine the mode converter 23 and 26 dimensions. Since the $TM_{01}$ mode must be maintained throughout the transition section, the minor axis B, FIG. 3(*b*), is typically less than the input waveguide diameter so as to not generate unwanted higher order modes. The $TM_{01}$ mode in a cylindrical waveguide can be viewed as an infinite set of plane waves such that the collection of all the plane normal vectors at any concentric circle within the cylinder forms a portion the surface of a cone as shown in FIG. 4(*a*). Similarly, the $TM_{01}$ mode in an elliptical waveguide may be viewed as an infinite set of plane waves such that the collection of all the plane normal vectors at any concentric ellipse within the elliptic cylinder forms a portion of the surface of an elliptic cone. The cylindrical waveguide $TM_{01}$ mode is an elliptical waveguide $TM_{01}$ mode for an elliptical waveguide of zero eccentricity. A 2-dimensional slice of this cone parallel to and through the cylinder axis reveals two plane waves traveling at angle±γ as shown in FIG. 4(*b*). Boundaries of the proper length can be formed which cause the plane waves to emerge at the same angle γ (gamma), and form a single radiated beam of energy. The resultant radiation emerges as shown in FIG. 4(*b*) where γ is the average angle of radiation (the beam maximum). If an elliptical or cylindrical waveguide 24, FIG. 3(*b*), is attached to the beveled output 20, then the bevel angle α (alpha) is chosen such that the output aperture 22 is perpendicular to the average angle of radiation.

$$\alpha = 90° - \gamma$$

where:

$$\gamma = atan\left(\frac{\beta_f}{\beta_\rho}\right) = atan\left(\frac{\sqrt{\beta^2-\beta_\rho^2}}{\beta_\rho}\right)$$

$$\gamma = atan\left(\sqrt{\left(\frac{2\pi f r}{v\chi_{01}}\right)^2 - 1}\right)$$

since $$\beta = \frac{2\pi f}{v}, \beta_\rho = \frac{\chi_{01}}{r}$$

and f=center frequency of operation r=radius of input cylindrical waveguide $\chi_{01}$=first zero of the zero order Bessel's Function v=free space phase velocity For elliptical waveguides (Kretzschmar, formulae of elliptical waveguides):

$$\beta_2 = \beta\sqrt{1-\left(\frac{\lambda}{\lambda_{o,l}^{cutoff}}\right)^2}$$

$$\beta_2 = \sqrt{\beta^2 - \frac{4q_{o,l}}{\rho^2}}$$

$$\text{where; } \lambda_{o,l}^{cutoff} = \frac{\pi a e}{\sqrt{q_{0l}}}$$

$$\rho = ae$$

a=ellipse major axis e=eccentricity $q_{0,1}$=1st root of the o'th order Mathieu Function λ=free space wavelength $\lambda_{0,1}^{cutoff}$=cutoff wavelength for $TM^c_{01}$ mode. FIG. 5 illustrates cutoff wavelengths for elliptical and cylindrical waveguides.

$TM^c_{01}$ is the $TM_{01}$ mode designation for an elliptical waveguide. The following set of equations are used to solve for $q_{0,1}$ and eccentricity e, and spatial separation constant $a_0$, where $A_0$, $A_2$, $A_4$, $A_{2r}$, $A_{4r+2}$ and $A_{2r-2}$ are coefficients to be eliminated through simultaneous solution:

$$\alpha_0 A_0 - q_{0,1} A_2 = 0$$

$$(\alpha_0 - 4) A_2 - q_{01}(A_4 + 2A_0) = 0$$

$$(\alpha_0 - 4) A_{2r} - q_{0,1}(A_{4r+2} + 2A_{2r-2}) = 0 \quad r \geqq 2$$

$$Ce_0(\xi_0, q_{0,1}) = 0$$

where:

$Ce(\xi_0, q_{0,1})$=zero'th order modified Mathieu function $$\xi_0 = a\cosh\frac{1}{e}$$

Figure 6A:
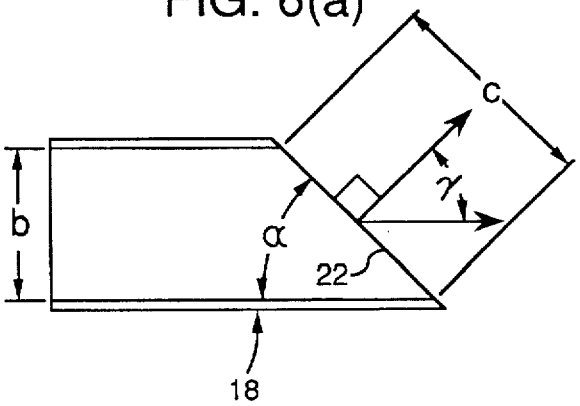
FIG. 6(*a*) is a side cross-section of an elliptical waveguide with a bevel cut end.
Figure 6B:
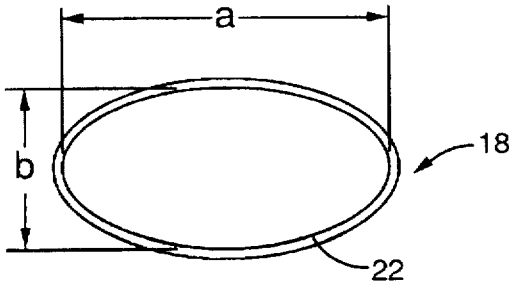
Figure 7A:
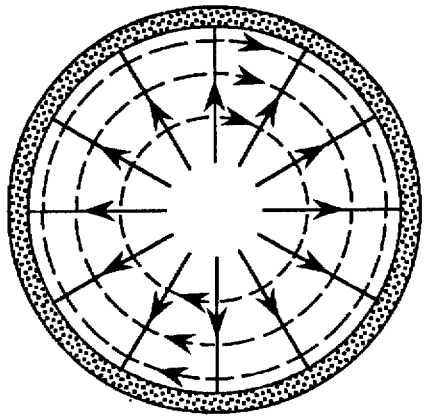
FIG. 7(*a*) illustrates a $TM_{01}$ mode distribution in a cylindrical waveguide (Ramo, Whinnery, and Van Duzer, page 432). The solid lines represent the electric field and the dashed lines represent the magnetic field.
Figure 7A:
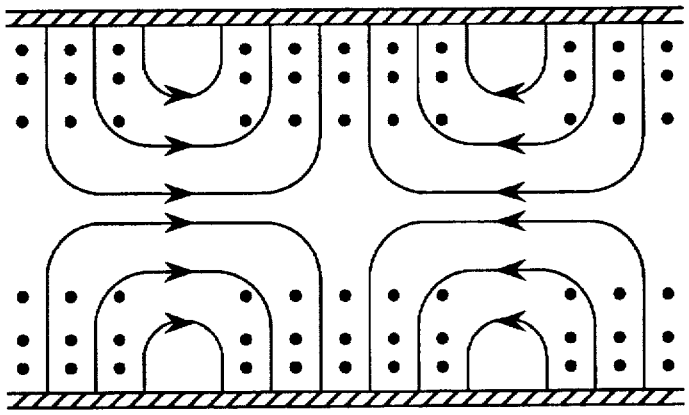
Figure 7B:
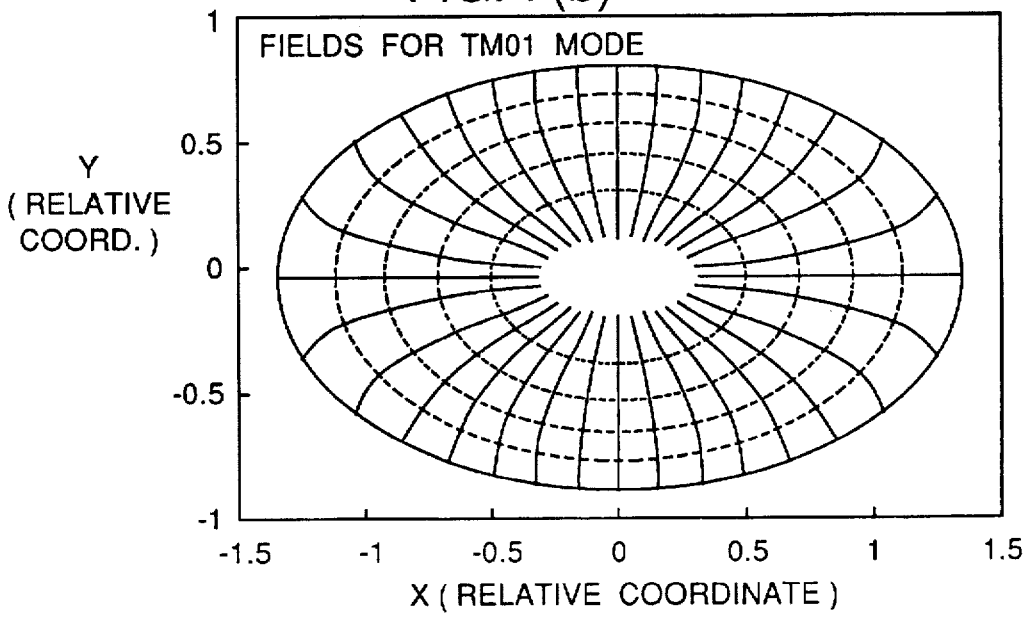
Figure 7C:
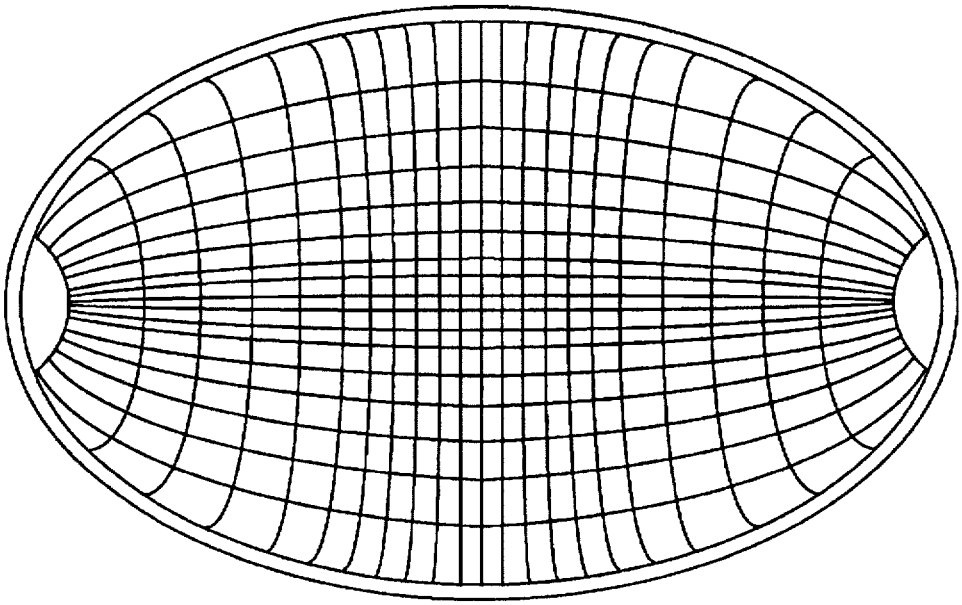
Figure 7D:
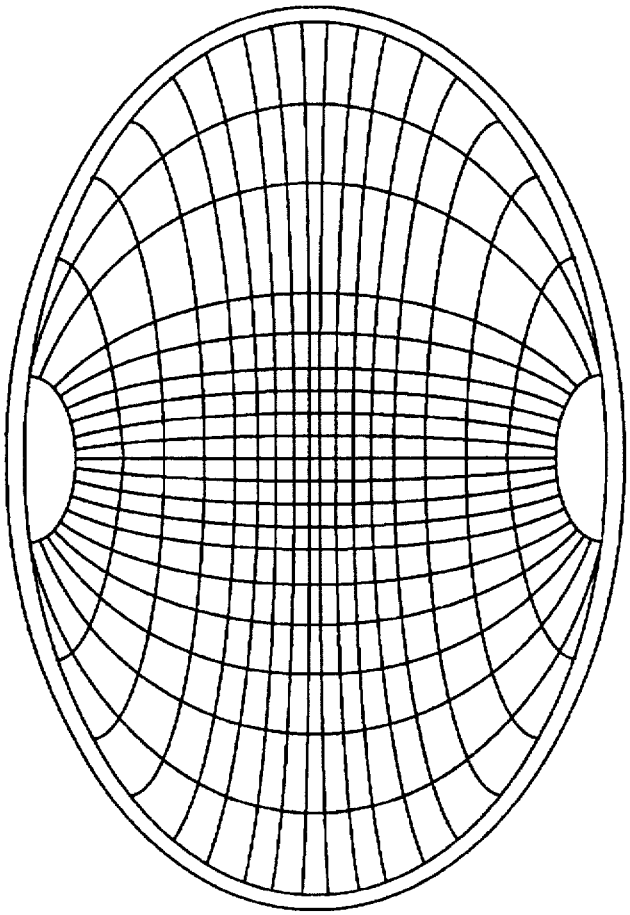
Figure 8A:
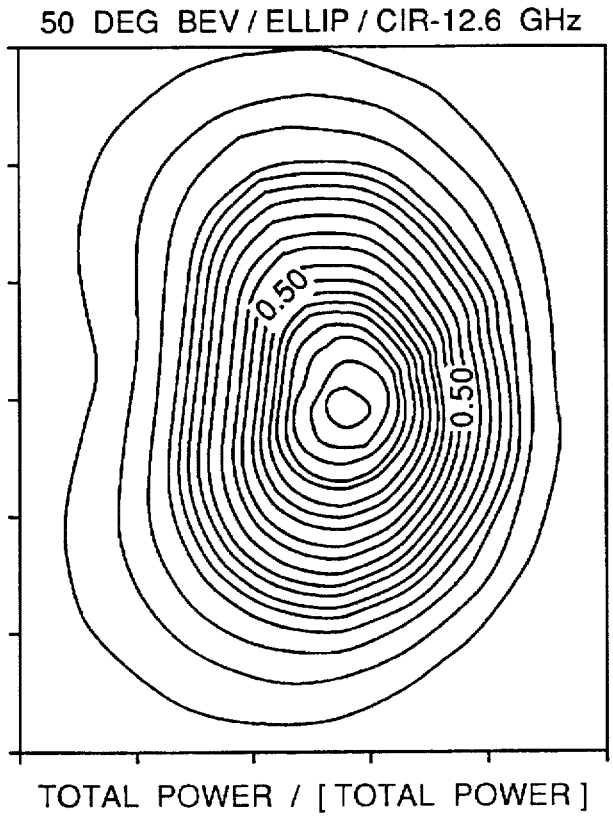
FIGS. 8(*a*)–(*f*) are farfield radiation pattern contour plots for the mode converters shown in the photograph of FIG. 12.
Figure 8B:
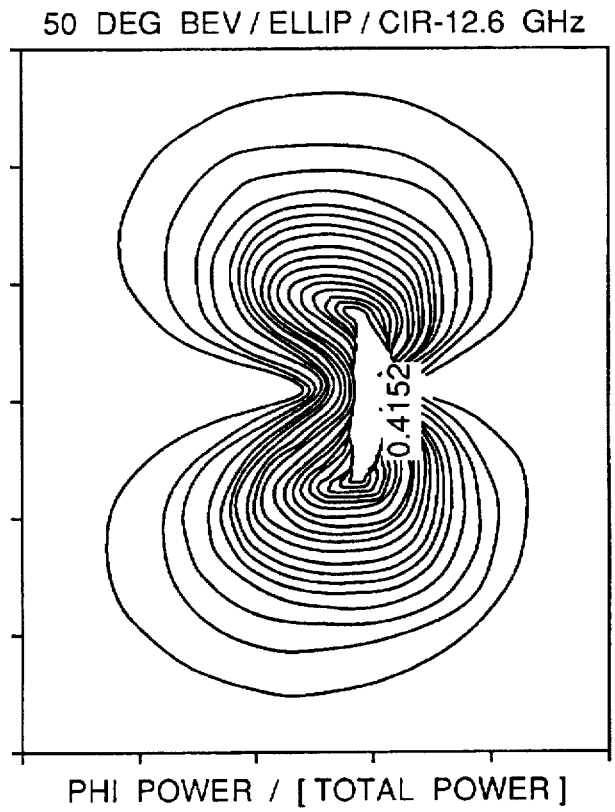
Figure 8C:
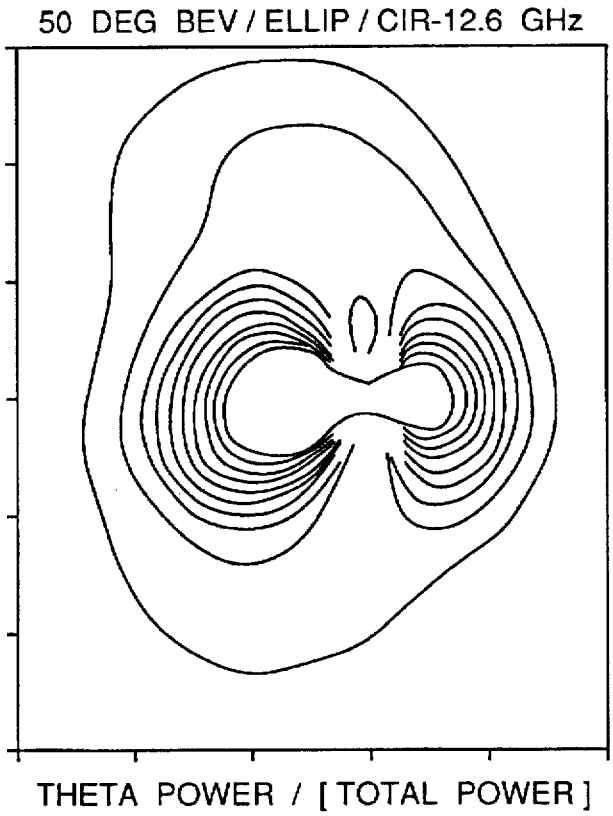
Figure 8D:
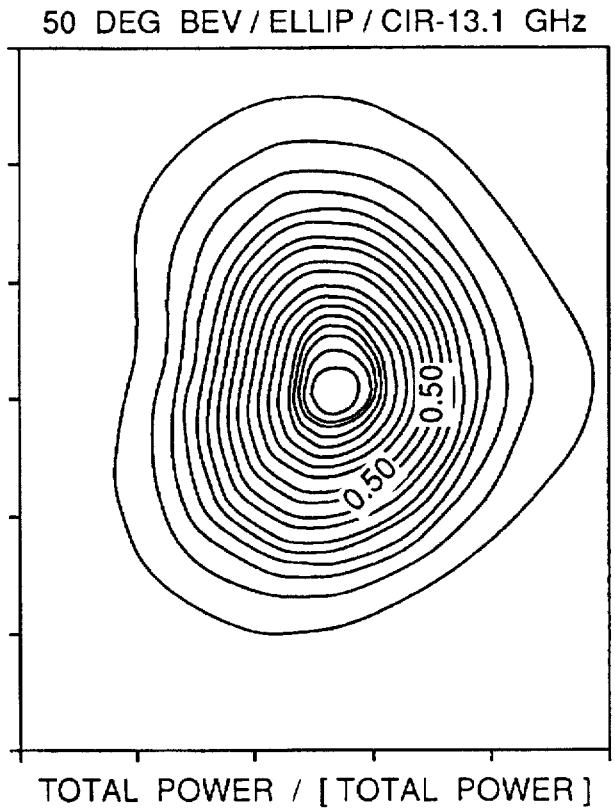
Figure 8E:
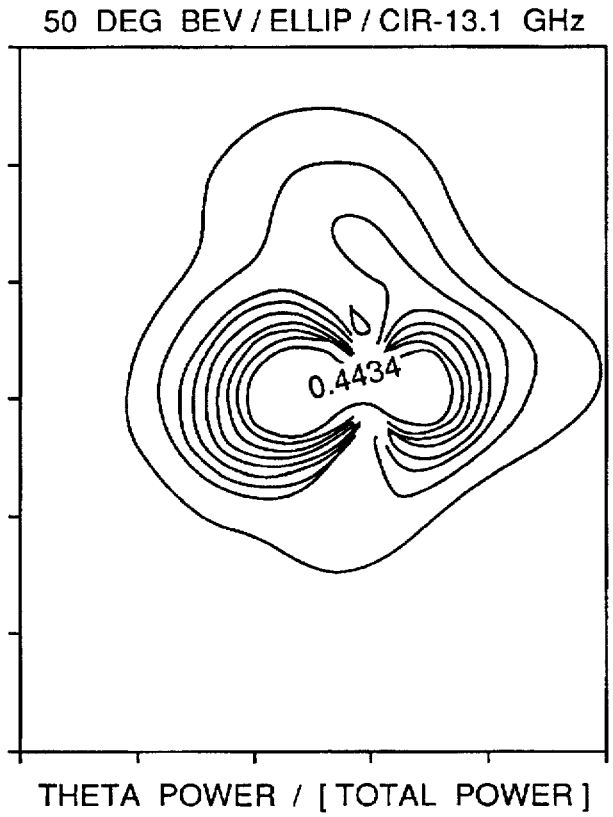
Figure 8F:
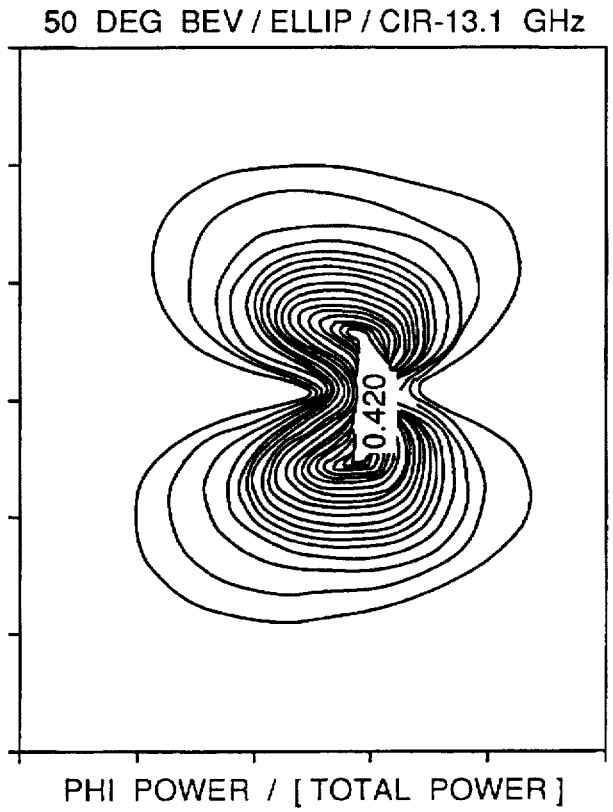
Figure 9A:
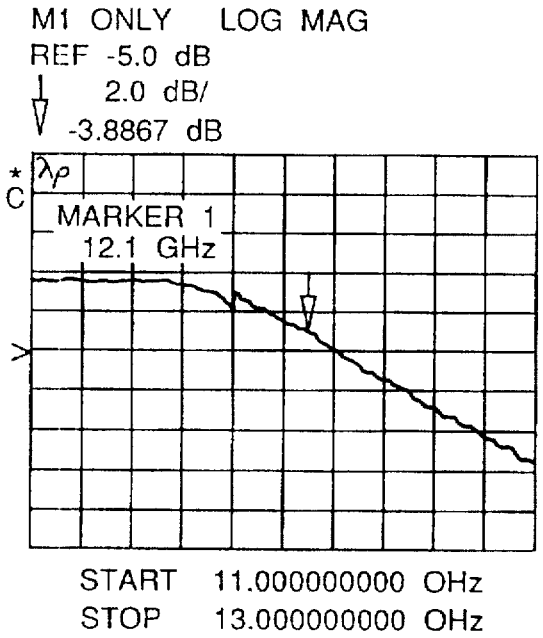
FIG. 9(*a*)–9(*d*) compare the present invention to prior art radiators by reflection measurements.
Figure 9B:
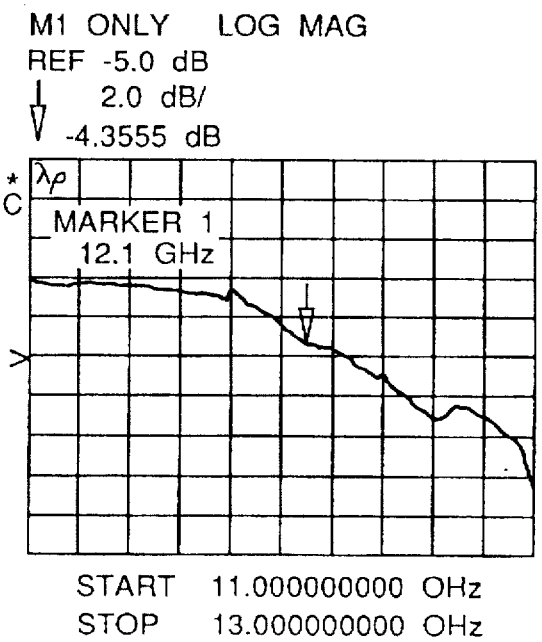
Figure 9C:
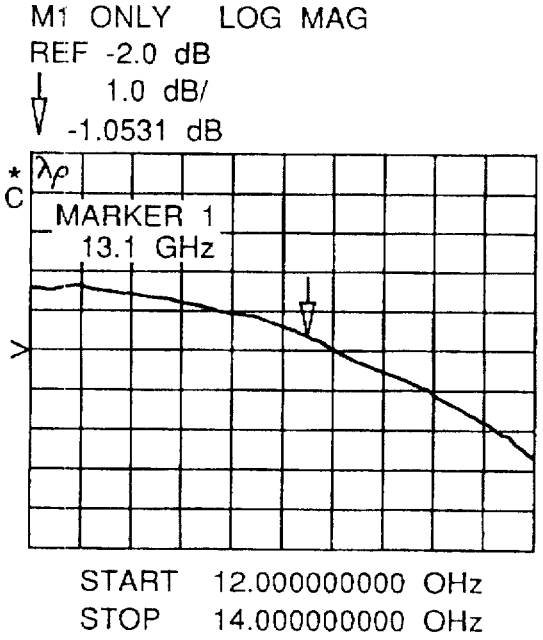
Figure 9D:
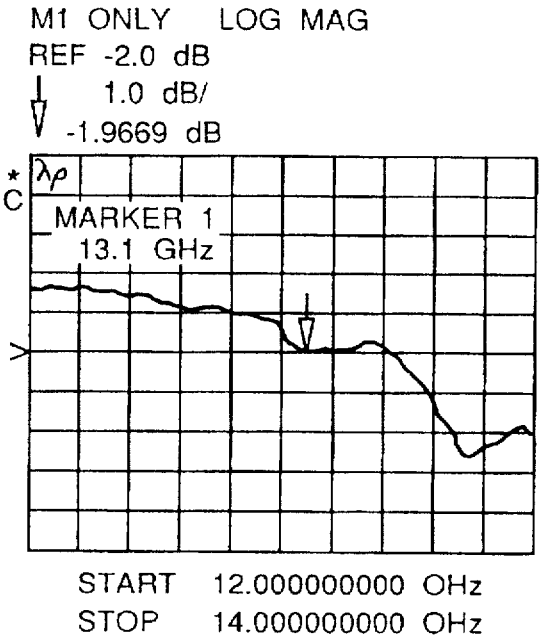

The zero'th order Mathieu function describes the $TM^c_{01}$ mode in perfect ellipitical waveguides. A working prototype of the invention was tested for e=0.58 with a cylindrical waveguide attached to the output 20. FIGS. 6(*a*) to 6(*b*) show a side view and a front view, respectively, of an elliptical waveguide with a bevel cut at angle α (alpha) as determined above. We see that for a circular aperture we want:

$$c = a = b/(\sin\alpha)$$

where a=elliptical waveguide 18 major axis (dimension C in FIG. 3(*d*)); b=elliptical waveguide 18 minor axis dimension B in FIG. 3(*b*)); c=circular aperture 22 diameter dimension G in FIGS. 2(*b*) and 3(*b*); and since:

$$e = \frac{\sqrt{a^2 - b^2}}{a} = \sqrt{1 - (\sin\alpha)^2}$$

$$e = \cos\alpha$$

and the eccentricity of the elliptical waveguide 18 is determined. The transition section (dimension E in FIGS. 2(*d*) and 3(*d*) should be at least two (2) operating frequency wavelengths long. In the transition section 14, FIG. 3(*d*), this helps to. maintain $TM^c_{01}$ mode purity.

There are several methods (that have been practiced for decades) for constructing the elliptical transition section 14, FIGS. 2(*b*) and 2(*d*): 1) electroforming over a substrate pre-machined in the shape of the transition. 2) casting the transition. 3) machining an appropriate substance by a computer controlled milling machine resulting in the desired transition. 4) machining an appropriate substance into a cylindrical waveguide which is then formed with an arrangement of elliptical dies of appropriate eccentricity for the transition. The last of these methods is by far the least expensive when just a few prototypes are necessary and has been successfully applied at this laboratory. If the transition section 14 is designed such that the circumference is constant throughout the entire length, then a hydraulic press may be used to feed the pre-machined cylindrical structure through the die system if desired. If the transition section 14 is designed such that circumference is not constant, then the die system may be used to uniformly press out the transition. Both of these approaches have been successfully performed at this laboratory. Casting (method 2) is by far the most economical means for mass production purposes, but is the most expensive means for a single prototype. Surface shaping of the output section is most easily accomplished by addition of a plastic that is formed and coated with a highly conducting paint. If a beveled output is needed for attachment of an elliptical or cylindrical waveguide 24, FIGS. 3(*a*) to 3(*d*), a band saw or milling machine may be used. Attachment of the cylindrical or elliptical waveguide can be readily accomplished by standard waveguide flange techniques. Once constructed, the converter input is then attached to any device delivering $TM_{01}$ mode power in a cylindrical waveguide of the same diameter. If needed, the cylindrical or elliptical waveguide attached to the output may be connected to a conical or elliptic horn for improved gain.

The invention functions by converting a mode (or set of modes) of a cylindrical waveguide to those of an elliptical guide in the transition section 14, FIG. 2(*d*).

Further conversion to TE modes takes place in and around the output aperture area 21, FIG. 2(*d*). In the present designs the mode converter functions by receiving at its input a $TM_{01}$ mode from a cylindrical waveguide and converts this in the smooth transition to the $TM^c_{01}$ mode for elliptical guides. Since a cylindrical waveguide is an elliptical waveguide of zero eccentricity, the $TM_{01}$ mode of the input cylindrical waveguide may be viewed as the elliptic waveguide $TM^c_{01}$ mode (this is rigorously very correct from a scientific viewpoint). From this point of view, no mode conversion takes place throughout the transition section 14 of FIG. 2(*d*). However it is viewed, the purpose of the transition section is to maintain the $TM^c_{01}$ mode throughout until delivered to the aperture area. In any practical device other spurious modes will also be generated through the transition section 14. This mode is then converted to a TE mode at the elliptical output aperture 22. If the design requires an elliptical or cylindrical waveguide matched to the output interface, conversion is primarily into the $TE_{11}$ mode, a fundamental mode, for the respective waveguides, and then into the TEM free space mode away from the device. If the design requires direct radiation from the output aperture, conversion is primarily into the TEM mode for free space away from the device. Working prototypes of the present invention for both applications have been designed, built, and tested in the Ku band (12.6 GHz to 18.2 GHz). Mode conversion from an input $TE_{01}$ mode to TE modes should also happen, but this has not been verified. FIG. 7(*a*) shows the cross section and longitudinal field distributions within the cylindrical waveguide input as noted in the reference to Ramo, where dashed lines represent the magnetic field within the guide. All TE and TM modes of elliptical waveguides are described by even and odd Mathieu functions except $TM^c_{01}$ and $TE^c_{01}$ and all other modes whose first subscript index is 0, which have only an even solution. Assuming that a gradual transition from cylindrical to elliptical waveguide is stable (a reasonable assumption given the nature of the waveguide solutions), the field distribution changes to that shown in FIG. 7(*b*) as noted in the reference of Goldberg et al. This is the $TM^c_{01}$ mode for elliptical waveguides. The uniformly distributed (z axis directed) current distribution in the cylindrical waveguide has now been more densely distributed along the minor axis walls of the elliptic section. This current distribution is favorable for launching the TE modes of both designs mentioned above. FIG. 7(*c*) and 7(*d*) show the $TE_{11}$ field distribution (with the same field convention) that will be present at the elliptical output aperture 22 depending on the final orientation of the output aperture. FIG. 7(*c*) shows the $TE^c_{11}$ mode distribution for an elliptical output aperture 22 where the bevel cut output 20 with angle, α, is greater than that required for a perfectly circular aperture ($\alpha = \cos^{-1}(e)$).

FIG. 7(*d*) shows the $TE^{s}_{11}$ mode distribution for an elliptical output aperture 22 where the bevel cut angle α is less than that required for a perfectly circular aperture. One can see from FIGS. 7(*c*) and 7(*d*) for zero eccentricity that both are the same and show the field distribution for a perfectly circular output aperture 22. Measured far field power patterns indicate that other modes are also present as would be expected in a practical device.

A $TM_{01}$ mode launcher was built and its mode purity verified by spherical 3-dimensional far field power pattern measurements consisting of over 4000 data points each. A standard gain pyramidal horn was used as the receiver. Several radiation power pattern measurements were taken in the Ku band for both designs mentioned above. All pattern measurements consist of both polar and azimuthal components where the total power is the sum of both components. The mode converter prototypes were attached to the $TM_{01}$ mode launchers and the resulting patterns measured. FIG. 8(*a*)–8(*f*) show the results of farfield radiation data taken for one working mode converter of FIG. 3(*a*)–3(*d*). These and the remaining contour plots are in a linear representation. All of the contour plots are represented with respect to the total power maximum. Since the total power plots are normalized to 1, each of the 19 contour lines represents 5% of the maximum power. This converter has a transition from an input cylindrical waveguide to the output elliptical waveguide having an eccentricity of 0.58. An angled cylindrical waveguide 24 is attached to the 50 degree bevel cut output 20 section. The farfield radiation contour pattern of FIG. 8(*a*) shows a nearly circular main beam at the 0.50 power level indicating a predominance of the $TE_{11}$ cylindrical waveguide mode. The figure eight patterns of the phi (azimuthal) and theta (polar) components (FIGS. 8(*b*) and 8(*c*) respectively) of the main beam support this conclusion. The asymmetries in all three patterns indicated the presence of other mode power in addition to $TE_{11}$ mode power. The measured directivity at this frequency is 12.6 dB. The same remarks may be made concerning the data represented by FIGS. 8(*d*)–8(*f*) taken at 13.1 GHz except that the measured directivity is 12.65 dB. The resulting total power pattern data indicates a highly directive predominantly plane polarized beam that has 6% less directivity than the theoretical calculated directivity of a pure $TE_{11}$ illuminated aperture (same area) making this device a very practical converter for radiation applications. The two patterns show very little degradation in beam quality over a 4% bandwidth indicating a satisfactory broad band operation.

FIGS. 9(*a*)–9(*d*) show a comparison of reflection measurements between a prior art cylindrical waveguide Nakajima-type mode converter of FIG. 1(*b*) (with a 20 degree bevel cut output) and the present invention of FIGS. 3(*a*)–3(*d*). FIGS. 9(*a*) and 9(*c*) show the reflected power of the prior art at 12.1 GHz and 13.1 GHz respectively. FIGS. 9(*b*) and 9(*d*) show the reflected power for the present invention at 12.1 GHz and 13.1 GHz respectively. Data was not taken at 12.6 GHz. The data shows that at both frequencies the reflected power is less for the invention than for the very adiabatic bevel cut prior art radiator.

Figure 10:
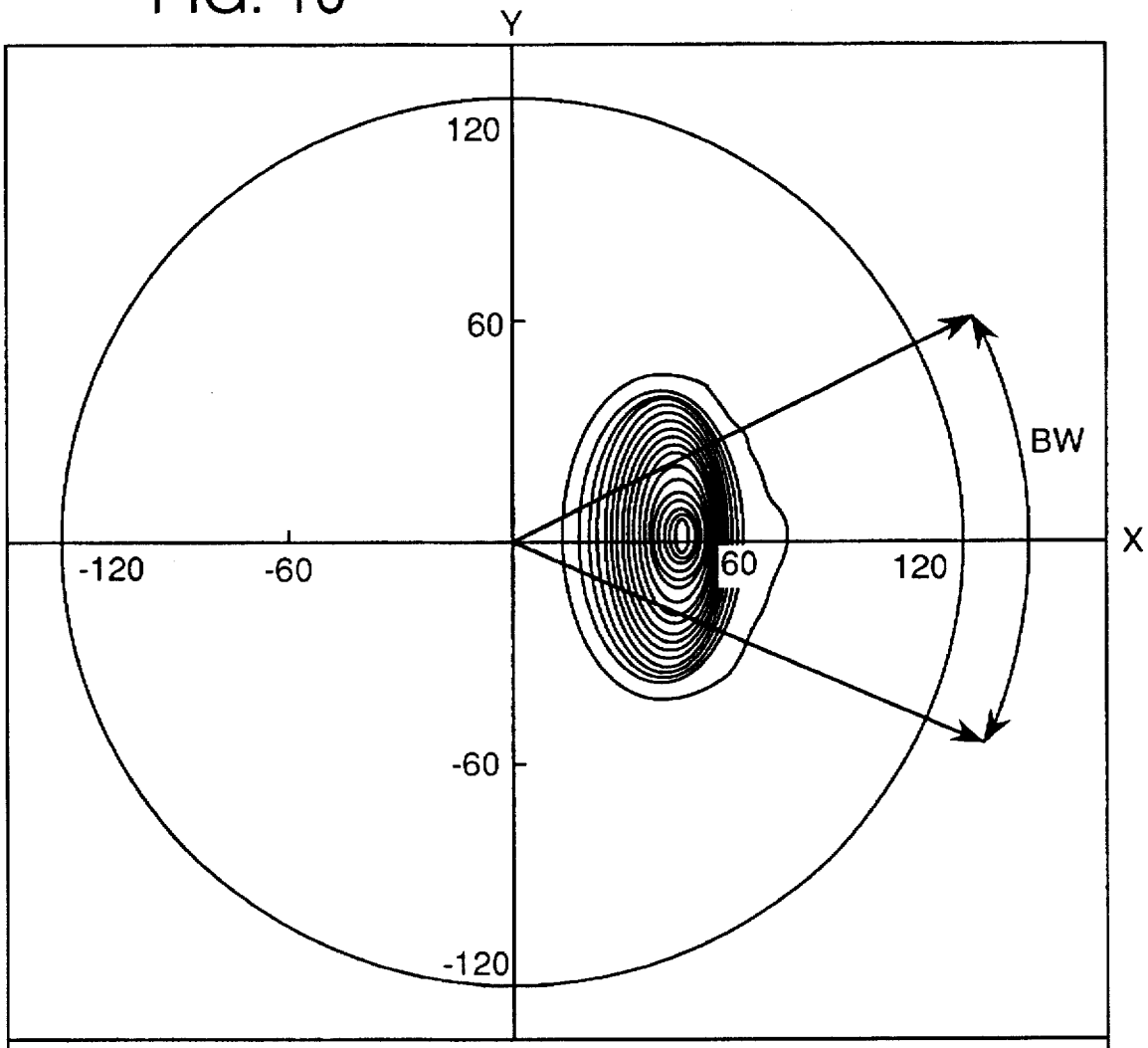
FIG. 10 is the farfield radiation pattern contour plot for the small aperture mode converter of FIG. 13(*a*).
Figure 11:
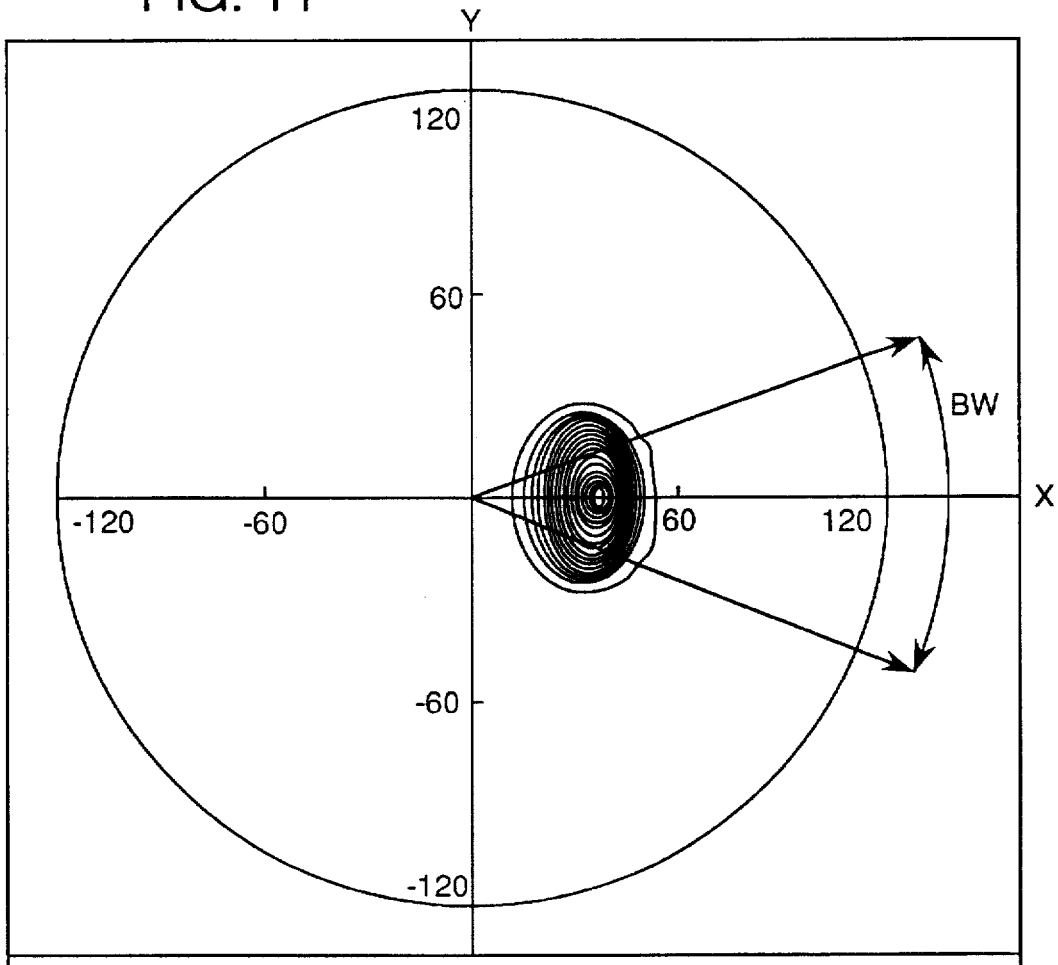
FIG. 11 is the farfield radiation pattern contour plot for the large aperture mode converter of FIG. 13(*b*).
Figure 13A:
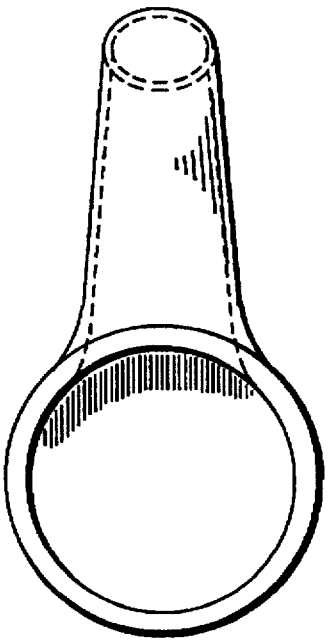
FIG. 13(*a*)–13(*b*) are drawings of the two mode converters taken from a photograph of the present invention.
Figure 13B:
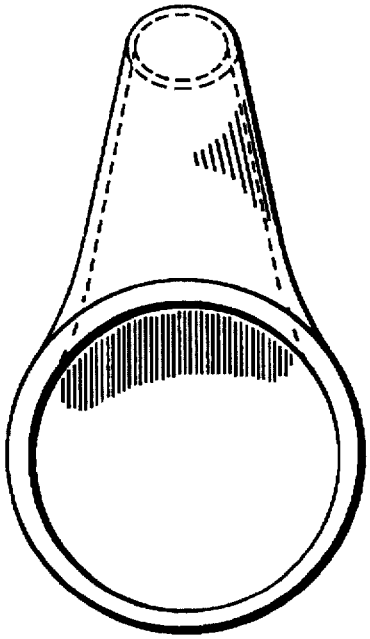
Figure 16:
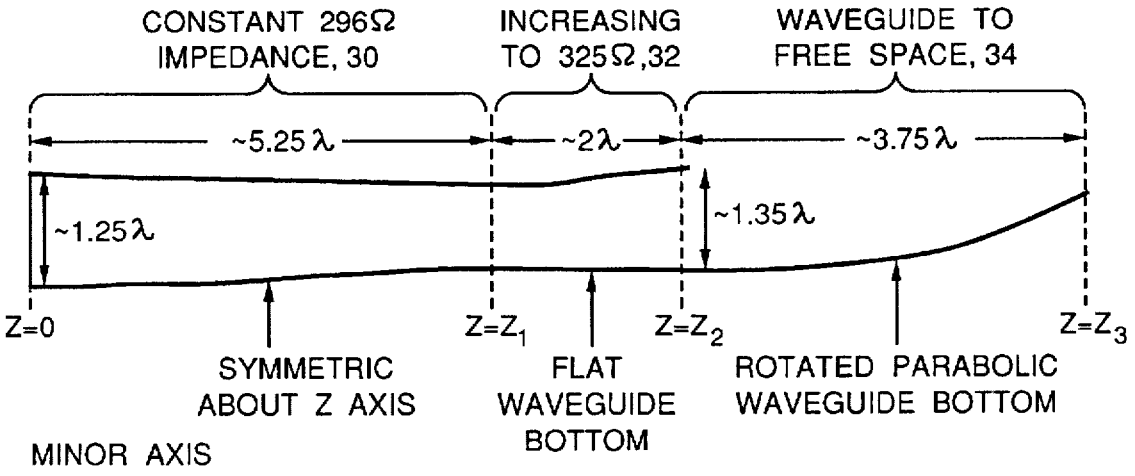
FIG. 16 is a computer generated minor axis cross-section of the illustration of FIGS. 14 and 15. It shows three distinct design regions of the mode converter of FIG. 13(*b*). The length of each is designated in terms of wavelength, λ. These regions are identified by: 1) "Constant 296 Ω Impedance" of length 5.25 λ, 2) "Increasing to 325 Ω" of length 2 λ, and 3) "Waveguide to Free Space" of length 3.75 λ.

FIG. 10 shows a contour plot at 18 GHz of the farfield radiation pattern for the mode converter of FIG. 13(*a*). This mode converter includes the cylindrical waveguide 16, transition section 14, and elliptical waveguide 18 depicted in FIGS. 2(*b*) and 2(*d*). In the aperture area 21, the elliptical waveguide minor axis is offset in a parabolic fashion as indicated in FIG. 16 by "Rotated Parabolic Waveguide Bottom". The elliptical waveguide 18 eccentricity is 0.90 and the elliptical output aperture 22 eccentricity is 0.72. The output aperture 22 and the area around it 21 is shaped to provide a desirable radiated farfield pattern with a directivity of 16.30 dB. FIG. 11 shows a contour plot at 18 GHz of the farfield radiation pattern for the mode converter of FIG. 13(*b*). This mode converter includes the cylindrical waveguide 16, transition section 14, and elliptical waveguide 18 depicted in FIGS. 2(*b*) and 2(*d*). In the aperture area 21, the elliptical waveguide minor axis is offset in a parabolic fashion as indicated in FIG. 16 by "Rotated Parabolic Waveguide Bottom". Also in the aperture area 21, the elliptical waveguide minor and major axis increase in proportion so as to maintain a constant eccentricity. This combination provides a much larger elliptical output aperture 22 than that of FIG. 13(*a*). The elliptical waveguide 18 eccentricity is 0.90 and the elliptical output aperture 22 eccentricity is nearly zero. The radiated farfield pattern reveals an almost circular beam with a directivity of almost 19 dB. A mode converter similar to this one has been designed and is being constructed for operation between 1.12 GHz and 3.95 GHz (L, W, and S bands). The following equations together with major axis, minor axis and aperture area measurements describe very accurately the waveguide inside surface of the Ku Band converter of FIG. 13(*b*).

$$\frac{x^2}{a^2(z)} + \frac{(y - f(z))^2}{b^2(z)} = 1$$

$$a(z) = a_0 + a_1 z + a_2 z^2 + a_3 z^3 + a_4 z^4$$
$$b(z) = b_0 + b_1 z + b_2 z^2 + b_3 z^3 + b_4 z^4$$
$$f(z) = \text{waveguide minor axis offset}$$

The coefficients $a_0$, $a_1$, $a_2$, $a_3$, $a_4$, $b_0$, $b_1$, $b_2$, $b_3$, $b_4$ are all constant and are calculated based on least squares 4th degree polynomial fits of the inside major and minor axis surface measurements of the mode converter of FIG. 13(*b*). In the 1st section ($z=0$ to $z=z_1$), $f(z)=0$ making the waveguide symmetric about the z axis. In the 2nd section ($z=z_1$ to $z=z_2$), $f(z)=b(z)-b(z_1)$. This causes the waveguide bottom to be flat throughout this section while the eccentricity is increasing. In the 3rd section ($z=z_2$ to $z=z_3$), $f(z)=b(z)-b(z_1)+c_0+c_1z+c_2z^2$ where $c_0$, $c_1$, and $c_2$ are calculated based on a least squares 2nd degree polynomial fit of the aperture area inside surface. This accounts for the rotated and offset parabolic waveguide bottom in the aperture area of the mathematical model. These features are depicted in FIG. 16.

Figure 14:
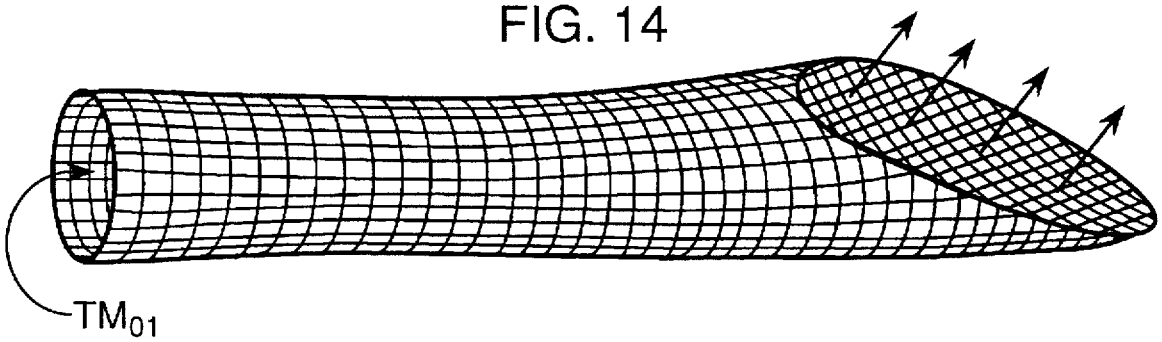
FIG. 14 is a computer generated illustration of the converter of FIG. 13(*b*). It was generated from actual major axis, minor axis and aperture area measurements of the mode converter of FIG. 13(*b*) and a general elliptical waveguide equation.
Figure 15:
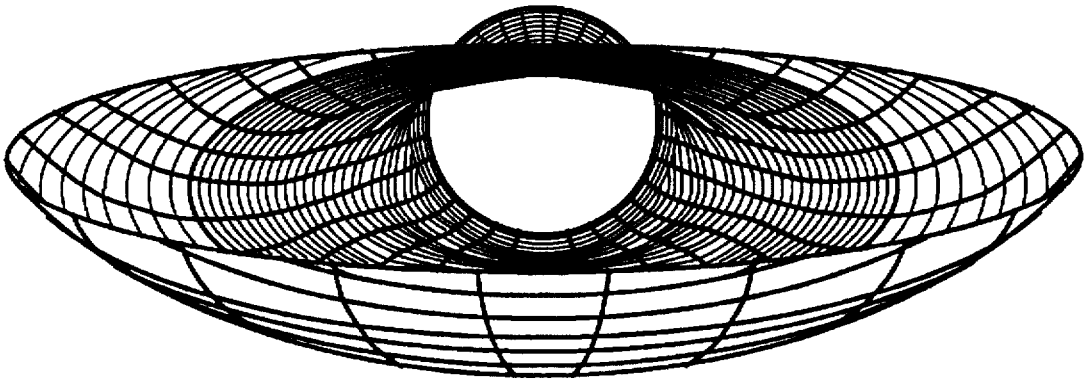
FIG. 15 is the same computer generated illustration of the converter of FIG. 13(*b*) from a front perspective.
Figure 17:
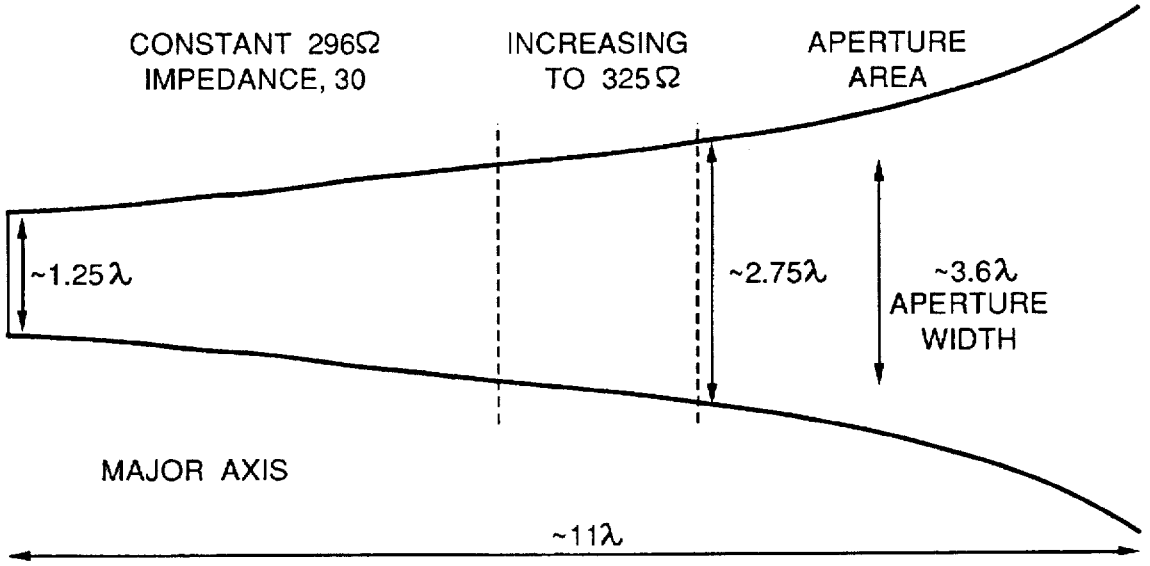
FIG. 17 is a computer generated major axis cross-section of the illustration of FIGS. 14 and 15.

FIG. 14 is a computer generated illustration of that Ku band prototype converter using this equation, at a side view, wherein the waveguide impedance is matched to free space through the entire transition and the output beam is a highly directional elliptical beam. FIG. 15 is a different view of same converter of FIG. 14 wherein a computer generated illustration of a Ku band prototype converter, looks into the output, wherein the input cylindrical waveguide transitions smoothly to 0.9 eccentricity. The elliptical waveguide is offset parabolically at the output and the final radiating surface is an elliptical paraboloid. FIG. 16 is a computer generated illustration of the cross-section of FIGS. 14 and 15. FIG. 16 shows some of the major features of the Ku band prototype including a constant impedance region 30, an increasing impedance region 32 and a waveguide to free space region 34 as well as the overall length (in terms of operating frequency wavelengths, λ). The minor axis is seen to decrease from the initial 1.25 λ input waveguide diameter and then increase to approximately 1.35 λ just prior to the aperture area in the waveguide to free space region. The aperture area shaped waveguide bottom is described by a rotated parabola. FIG. 17 is a computer generated illustration of the minor axis cross-section of FIGS. 14 and 15. It shows a constantly increasing minor axis throughout the entire length of the mode converter from 1.25 λ at the input to approximately 2.75 λ just prior to the aperture area. It also shows the total converter length of 11 λ and the approximate location and width of the elliptical output aperture.

Figure 12:
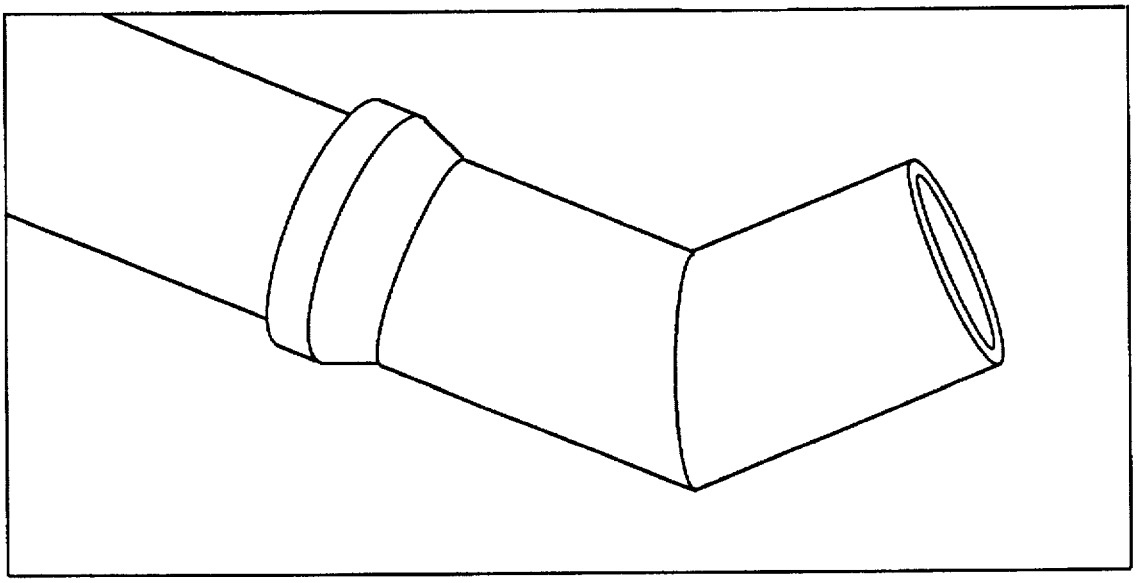
FIG. 12 is a photograph of a mode converter of the present invention.

The invention provides a compact structure. Referring to FIG. 3(*d*), it is seen that dimension F and D may be reduced to zero (this has been done to the converter depicted in the photograph of FIG. 12, thus making the device length dependent only on E, I, FIG. 3(*b*), and the bevel angle α. The mode converter in the photograph of FIG. 12 is approximately 4.5 λ long where E=2 λ, I≅2 λ and α=50°. The mode converter of FIG. 13(*a*) is approximately 11.6 λ in length, where referring to FIGS. 3(*b*) and 3(*d*), E≅7.9 λ, I≅0.0 λ, α=8°, G≅3.7 λ and the elliptical output aperture 22 eccentricity is approximately 0.72. The mode converter of FIG. 13(*b*) is approximately 12.0 λ in length, where E≅7.3 λ, I≅0.0 λ, α=8°, G=4.7 λ and the elliptical output aperture 22 eccentricity is approximately 0.55. Because of the nonlinear equation for eccentricity, a 0.55 eccentricity turns out to be physically very nearly circular. Depending on wave stability issues in the transition section 14, FIG. 2(*d*), and higher order mode generation issues in the aperture area 21 and elliptical output 22, E FIG. 2*d* possibly may be reduced further, providing a more compact mode converter.

As discussed earlier, fabrication costs are low, the main cost associated with machining elliptical dies. For low frequency mode converters, the dies may be made from wood as has been successfully done at this laboratory. Current high tech milling machines and lathes can be easily programmed to machine the desired elliptical pieces. The mount for the dies is easily machined by conventional methods.

The cost of material, machining and labor for forming the transition section is less than $4,000.00 for mode converters designed to operate in the Ku band and less than $18,000.00 for the L, W, and S bands if the method is by way of dies. The cost of wooden dies for the low frequency converters is much less than the metal ones used for the Ku band converters but the other related costs are much higher as would be expected for much larger structures. Its not possible to estimate the cost of aperture area shaping accurately since this was done experimentally for the prototypes.

Reflected power measurement results obtained with an HP8510 Network Analyzer reveal reflected power better than a Nakajima-type (described earlier) with a 20° bevel.

The flexibility of this mode converter makes the invention ideal for a wide range of radiation applications when the input energy is predominantly in the $TM_{01}$ mode. Because of the variety of beam shapes available using this technology this device may be used solely or in symmetric or non-symmetric scanning or non-scanning arrays.

Since a cylindrical or elliptical waveguide may be attached to the elliptical output aperture 22, FIGS. 3(*b*) and 3(*d*), and the angle α depends on the particular design parameters, the elliptical output aperture 22 may be any of a number of different eccentricities. The angled cylindrical waveguide 24 will then necessarily need to be elliptical with the same eccentricity as the output aperture.

This geometry would allow for a variety of output waveguide sizes and eccentricities.

This together with the fact that the input to the transition section may be elliptical allows for an infinite number of circumference, eccentricity, length, output bevel angle and aperture shaping combinations.

The following references are of interest: (1) P. D. Potter and A. C. Ludwig, "Beamshaping by Use of Higher Order Modes in Conical Horns," Northeastern Electronics Research and Engineering Meeting, November 1963. (2) Lan Jen Chu, "Electromagnetic Waves in Elliptic Hollow Pipes of Metal," Journal of Applied Physics, Vol. 9, September 1938. (3) David A. Goldberg, Jackson Laslett, and Robert A. Rimmer, "Modes of Elliptical Waveguides: A Correction," IEEE Trans. on MTT, Vol. 38, No. 11, November 1990. (5) O. Wanda and M. Nakajima, "Proceedings of the Sixth Joint Workshop on Electron Cyclotron Emission and Electron Cyclotron Resonance Heating", Oxford, 16–17 Sep., 1987. (6) Ramo, Whinnery, and Van Duzer, "Fields and Waves in Communication Electronics", John Wiley & Sons, Inc., 1965. (7) Jan G. Kretzschmar, "Wave Propagation in Hollow Conducting Elliptical Waveguides", IEEE Transactions on Microwave Theory and Techniques, vol. MTT-15, No. 2, February 1967. (8) P. Moon and D. E. Spencer, "Field Theory Handbook", Springer-Veriag, Berlin, Heidelberg, New York, London, Tokyo, Second Edition 1971. This reference teaches types of elliptical coordinate system. (9) M. Singer, "Elliptical Waveguide for High Power Operation", Lab. Project 920–251, Progress Report 1, 10 Sep., 1968.

Clearly, many modifications and variations of the present invention are possible in light of the above teachings and it is therefore understood, that within the inventive scope of the inventive concept, the invention may be practiced otherwise than specifically claimed.

What is claimed is:

1. A mode converter for a microwave system, said mode converter being able to receive microwave energy at an input thereof in the form of a $TM_{01}$ mode of a perfectly circular waveguide, said mode converter being able to output microwave energy predominantly in the form of a fundamental TE mode where said fundamental mode radiates a single narrow beam of energy into space, said mode converter comprising:

a transition section being a first section of elliptical waveguide having a straight axis and of predetermined length, said input of said mode converter being in said first section, said first section having a circular cross-sectional shape with a radius, $r_1$, at a first position and an elliptical cross-sectional shape at a second position, an interior surface of the first section between the first and second positions described by a mathematical equation of the form $x^2/a^2(z)+y^2/b^2(z)=1$, wherein x, y, and z are Cartesian coordinates, a major axis function a(z) is a mathematical function describing a major axis radius of the elliptical waveguide, a minor axis function b(z) is a mathematical function describing a minor axis radius of the elliptical waveguide, said major axis function a(z) having values greater than said radius $r_1$ such that the major axis radius is generally increasing in a non-abrupt fashion from the first position to the second position, the minor axis function b(z) having a range of values greater than zero and less than or equal to radius r1 such that the minor axis radius is generally decreasing in a non-abrupt fashion from the first position to the second position, and an output section being a second section of waveguide of elliptical cross-section of a predetermined length, the second section connected to said first section at said second position in a manner such that internal surfaces of both the first and the second sections establish a continuous and non-abrupt elliptical waveguide, said second section having an interior surface described by $x^2/a^2(z)+(y-f(z))^2/b^2(z)=1$, wherein a(z) and b(z) are said mathematical functions having changing values from the second position to a third position, an offset function f(z) is a mathematical function which offsets the second section of waveguide in a minor axis radius direction, said second section of waveguide terminated at a flat plane thereby establishing a beveled end beginning at a first intermediate position between the second position and the third position and ending at the third position, said flat plane having a predetermined angle, $\alpha$, with respect to said first section straight axis, and said predetermined angle $\alpha$ having a value greater than zero degrees and less than 90 degrees, said flat plane further oriented perpendicular to a plane coincident with the second section waveguide minor axis radius, a bounded area produced by the second section waveguide internal surface at the flat plane establishing an output aperture having an approximately elliptical shape, said output aperture being able to have a waveguide of predetermined length and shape attached thereto;

whereby said transition section providing a means to preserve the input $TM_{01}$ mode from the first position to the second position, said output section providing a means to convert the $TM_{01}$ mode to a fundamental TE mode at the output aperture.

2. A mode converter as defined in claim 1, said major axis function a(z) having increasing value from the second position to the third position, said second section minor axis function b(z) having decreasing value from the second position to the third position, said offset function f(z) having a value necessary to establish from the second position to a second intermediate position prior to the third position an offset elliptical waveguide with a straight waveguide bottom, said waveguide bottom defined in terms of said x and y Cartesian coordinates, said offset function f(z), and said minor axis function b(z), by equations y=f(z)–b(z) and x=0, said offset function f(z) having value necessary to establish from the second intermediate position to the third position an offset elliptical waveguide with a parabolic-like waveguide bottom said offset function together with said beveled end producing an approximately elliptical shaped output aperture which radiates a single beam of energy into space at an angle, $\gamma$, with respect to said first section waveguide axis.

3. A mode converter as defined in claim 1, said major axis function a(z) having increasing value from the second position to the third position, said second section minor axis function b(z) having increasing value from the second position to the third position, said offset function f(z) having a value necessary to establish from the second position to a second intermediate position prior to the third position an offset elliptical waveguide with a straight waveguide bottom, said waveguide bottom defined in terms of said x and y Cartesian coordinates, said offset function f(z), and said minor axis function b(z), by equations y=f(z)–b(z) and x=0, said offset function f(z) having a value necessary to establish from the second intermediate position to the third position an offset elliptical waveguide with a parabolic-like waveguide bottom, said offset function together with said beveled end producing an approximately elliptical shaped output aperture at said flat plane which radiates a single beam of energy into space at an angle, $\gamma$, with respect to said first section waveguide axis waveguide axis.

4. A mode converter as defined in claim 3 having a straight approximately elliptical waveguide of predetermined length attached to said approximately elliptical shaped output aperture at said flat plane, said attached straight approximately elliptical waveguide having an internal bounded area coincident with the approximately elliptical shaped output aperture at said flat plane, an axis of said attached straight elliptical waveguide having approximately said angle, $\gamma$, with respect to said first and second sections continuous elliptical waveguide axis.

5. A mode converter as defined in claim 3 having a straight approximately elliptical waveguide of predetermined length attached to said approximately elliptical shaped output aperture at said flat plane, said attached straight approximately elliptical waveguide having an internal bounded area coincident with the approximately elliptical shaped output aperture at said flat plane, an axis of said attached straight elliptical waveguide having approximately said angle, $\gamma$, with respect to said first and second sections continuous elliptical waveguide axis.

6. A mode converter as defined in claim 1 wherein said major axis function a(z) and said minor axis function b(z) have such minimal changes from the second position to the third position of said output section so as to establish a second section with essentially constant major and minor axes radii, said offset function f(z) being of zero value, said first and second sections thereby producing a continuous elliptical waveguide with straight axes aligned and with an elliptical aperture at said flat plane which radiates a single beam of energy into space at an angle, $\gamma$, with respect to said straight axis.

7. A mode converter as defined in claim 6 having a straight elliptical waveguide of predetermined length attached to said elliptical shaped output aperture at said flat plane, said attached straight elliptical waveguide having an internal bounded area coincident with the elliptical shaped output aperture at said flat plane, an axis of said attached straight elliptical waveguide having approximately said angle, $\gamma$, with respect to said first and second sections elliptical waveguide axes.

* * * * *